United States Patent [19]

Colli et al.

[11] Patent Number: 4,865,260

[45] Date of Patent: Sep. 12, 1989

[54] EQUIPMENT AND PROCESS TO SUPPLY WINDING TUBES TO THE INDIVIDUAL WINDING STATIONS OF A TEXTILE MACHINE

[75] Inventors: Luigi Colli; Roberto Badiali; Giosuè Franci, all of Pordenone, Italy

[73] Assignee: Savio S.p.A., Pordenone, Italy

[21] Appl. No.: 97,746

[22] Filed: Sep. 17, 1987

[30] Foreign Application Priority Data

Sep. 29, 1986 [IT] Italy ..... 21844 A/86

[51] Int. Cl.[4] ..... B65H 67/04; B65H 67/06

[52] U.S. Cl. ..... 242/35.5 A; 57/268; 57/270

[58] Field of Search ..... 242/35.5 A, 35.5 R; 57/268, 269, 270, 90

[56] References Cited

U.S. PATENT DOCUMENTS

| | | | |
|---|---|---|---|
| 3,398,521 | 8/1968 | Bell et al. | 57/269 X |
| 3,627,107 | 12/1971 | Di Mauro | 57/90 X |
| 3,735,576 | 5/1973 | Nelson | 57/268 X |
| 3,768,241 | 10/1973 | Nelson et al. | 57/268 X |
| 4,040,573 | 8/1977 | Burysek et al. | 242/35.5 A |
| 4,154,411 | 5/1979 | Kamp et al. | 242/35.5 A X |
| 4,598,881 | 7/1986 | Lattion | 242/35.5 A |
| 4,610,405 | 9/1986 | Noshi | 242/35.5 A |
| 4,641,740 | 2/1987 | Grecksch et al. | 242/35.5 A X |
| 4,688,735 | 8/1987 | Shinji et al. | 242/35.5 A |
| 4,702,427 | 10/1987 | Raasch | 242/35.5 A |

FOREIGN PATENT DOCUMENTS

| | | | |
|---|---|---|---|
| 2816418 | 10/1979 | Fed. Rep. of Germany | 242/35.5 A |

*Primary Examiner*—Stanley N. Gilreath

*Attorney, Agent, or Firm*—Stevens, Davis, Miller & Mosher

[57] ABSTRACT

Equipment and process to supply winding tubes to individual reeling stations of a textile machine, and to carry out the subsequent insertion of a new winding tube between the bobbin holder arms of a collection station. The equipment comprises an accumulator device to position a number of reserve winding tubes in a spaced and aligned condition enabling transfer of an individual winding device axially to a collecting user device; a belt or cable transfer device for transferring the winding tube in axial position, to a winding station upon request by the winding station, or on a time preceding request; and a device for intercepting, collecting and inserting a new winding tube between the bobbin holder arms of the winding station.

15 Claims, 5 Drawing Sheets

EQUIPMENT AND PROCESS TO SUPPLY WINDING TUBES TO THE INDIVIDUAL WINDING STATIONS OF A TEXTILE MACHINE

The present invention relates to an apparatus and a process to carry out the transfer of the winding tubes to be used on a bobbin producing textile machine, e.g., a coner machine or a spinner or twister frame.

More particularly, the present invention relates to a system preforming the task of supplying winding bodies from an ordered storage accumulator, external to the winding operative front, to the individual reeling stations, along the movement and guide track of a linear belt or cable conveyor means.

The concept of "winding bodies" relates to empty winding bodies, or to winding bodies bearing wound threads, or with threads partially wound on them, but it relates mainly to conical or cylindrical, or substantially cylindrical, empty winding tubes, to be used on collection textile machines.

On a textile machine, e.g, a winder machine or a free-thread-ends spinning frame, provided with many winding stations closely positioned side-by-side relatively to each other, the threads, taken from pirns, or from cones being reeled off, are collected on frustoconical or cylindrical winding tubes, forming bobbins having geometrical shapes and dimensions predetermined on the basis of the manufacturing process.

For example, the contrivance has been long known in the art, which consists in providing each winding station with a small fixed-sector reserve of empty winding tubes, and in integrating, from time to time, back into the system the reserve, by means of a person entrusted with the reintegration task.

Such a reserve of winding tubes is usually structured as a cartridge magazine. The individual winding tubes are positioned above each other, and they are individually withdrawn from the bottom by means of levers systems installed at each individual collection station, or they are manually removed by the machine attending operator.

The need existed however to automate these manually performed operations which are disadvantageous from an operating efficiency standpoint, due to inefficient accessibility of the winding tubes, and the troublesome and burdensome operations from an organizational viewpoint. Such devices, moreover, positioned along the whole machine front, constitute an expensive assembly, because each station requires a reserve sector.

On the other side, it is also known, in some structural solutions, e.g., from published Japanese patent application 165595/83, not to equip each winding station with a winding tube reserve sector.

In such structural solutions, the winding tubes are suitably housed, in the presence of limited room conditions, by a bobbin-replacement mobile unit, equipped with devices to automatically perform the bobbin doffing and empty winding tube insertion steps.

The reserve of winding tubes, prearranged to feed winding stations, has limitations in assisting a whole operating front when the operating front is constituted by a large number of closely positioned side-by-side winding stations.

The closely positioned operative fronts represent the most widely used system in the textile industry. This system is based upon better operative management, together with the higher general cheapness of the whole winder machine. Rather often, due to the casual nature of the bobbin filling time, the operative doffing requirement is simultaneously presented to the operator by a considerably large number of winding stations, wherein the prefixed bobbin winding diameter and thread length has been simultaneously reached.

As a consequence, the operator must supply a large number of winding tubes to feed the bobbin holder arms of the winding stations. Such a requirement often results in a large number of winding tubes being needed than can be provided by the mobile doffing unit, which, after supplying the last winding tube, must move to an external position relatively to the collection operative front, in the prearranged area for its reserve accumulation to be restored. After that the reserve accumulation is restored, the mobile doffing unit is returned back to the stations in waiting condition, waiting for the new winding tube to be inserted.

In this type of automation, the standstill waiting time for the various winding station may be long. Such waiting times cause a considerable reduction in machine production efficiency, decreasing its production rate.

This type of system has the drawback that the number of winding tubes which can be received on the travelling doffing automatic device varies within wide limits, due to the dimensions, and conicalness of the winding tubes. Variability in the dimensions of the winding tubes beyond certain limits, makes it necessary to recalibrate for size the elements whose material positioning contributes to the accumulation and guide area of the reserve. The winding tubes housed on the travelling unit must be positioned and aligned with a certain precision. The conicalness of the winding tubes considerably amplifies said difficulties of positioning and guidance, and not seldom such aspect causes functional blocks in the winding units, during the step of insertion of the new winding tube between the bobbin holder arms, with the interruption of the automatic doffing cycle, rendering necessary the assistance by the machine attending operator. The cost of manpower necessary to carry out these emergency interventions represents a not negligible factor in production costs computation. Due to the high collection speeds reached in the present machines, such a hindrance, as the one described, assumes a considerable importance due to the delays it causes in the following steps of the operating cycle.

A purpose of the present invention is therefore to reduce the high manpower costs, by providing an equipment able to automate the whole cycle of thread collecting tubes supply, without requiring any manual operations.

A further purpose of the invention is to secure an ordered operation of the whole step of supply of the thread collecting tubes to the winding stations, in such a way that defects and disadvantages in connexion with the arrangements as provided at present by the prior art, together with those hereinabove listed, can be overcome.

In the present specification, for the sake of shortness, reference will be made to the use of the present invention on an automatic coner machine. It should be understood that all that is specified for cross winding coner machines is valid also for any type of open-thread spinning frame, or twister frame, or doubling machine; or any type of textile machine, where a supply of winding tubes is required, to feed the individual winding stations since, the differences, which characterize the types of textile machinery, have no influence on the equipment according to the present invention.

The equipment which constitutes the subject-matter of the present invention does not alter in any way the operating system, the devices and the operative elements of the automatic coner machine, so that the traditional coner machine is not described, but only reference is made to the portions thereof which involve and clarify the use of the present invention, and, precisely, to the automatic doffing unit, and to the arm(s) of the bobbin holder frame.

The pirn, which is formed by re-winding the thread produced by a spinning frame, in particular a ring spinning frame, is wound on a cone, in a shape and within dimensions suitable for removing a possible faulty portion of the thread.

An automatic coner machine, used in the re-winding process, is constituted by a plurality of winding units. The thread extracted from a pirn is wound on a cone which is driven to revolve at a high speed by a drive roller. In such an automatic coner machine, on a whole machine front usually one single thread type is wound. Thus, in this way, on the cones only one type of thread is collected, by using winding tubes, all of which have the same shape and the same color, in that no differentiations are necessary. However, when the simultaneous collection is required of a plurality of different thread types along the winding front of the individual coner machine, the specific threads must be collected on specific winding units grouped in sectors wherein cones are formed, which have to be necessarily distinguished form each other, by type of wound thread, during the sequential steps of the processing cycle within the whole productive process.

The purpose of the invention is to provide for the production process to be easily adjustable, as required, to account for a plurality of batches of different threads, to be flexible enough to match the different market areas and to meet all the requirements posed by the users. In this case, coner machines are made ready, on each of which one or more types of thread are wound. In this way, the use is optimized of the collection units, which are advantageously grouped in winding sectors, whose extensions are a function of the amount and characteristics of the individual thread batches which are simultaneously processed.

It is advantageous as well to be able to operate the machine by collecting two different types of coned thread when the batch-end change is performed.

On considering the above, and the defects and the disadvantages connected with the present devices as provided by the prior art, the purpose of the present invention is to provide equipment to supply winding tubes, of any type, to the individual reeling stations of a textile machine, and to allow an individual coner machine to perform the winding of a plurality of thread types, from different batches, with cones being formed, which can be distinguished from one another thanks to the different color, shapes and geometrical dimensions of the various winding tubes.

More particularly, the equipment according to the present invention is composed by:

one or more ordered reserve accumulations wherein winding bodies are stored;

a withdrawal actuation device, inserted in the top portion of each accumulation, which performs the steps of dispensing and consignment of the individual winding tube to a sloping chute, on request by the automatic doffing unit, or on request by the collection station;

a belt transfer device, by which the winding tube is conveyed and immediately fed to the winding position for which it was required;

a mechanical interceptor device, of shutter or blade type, which brakes, stops and positions the winding tube, which is travelling along in its axial direction, to keep it in the suitable position for the subsequent handling;

a taking device, of the arm equipped with tongs-shaped clamping means, to perform the necessary transfer for the insertion and the clamping of the new winding tube on the cone holder frame.

The feeding flow of the winding tubes to the individual collection stations is secured, in coordinated cooperation, by the actions of preparation of the reserve accumulation, winding tube withdrawal, transfer, and interception and consignment to the cone holder frame.

As the accumulator device, a storage unit (magazine) is provided, wherein the winding tubes are stored in spaced condition with respect to each other. Such reserve accumulators are characterized in that they are provided with a plurality of protruding peg elements, identical to one another, suitably spaced apart from each other, which can be intermittently indexed, or stepwise moved along sliding traction lines, starting from the winding tube feed area, up to the winding tube dispensing area. Advantageously, with the reserve accumulator that should be at least a tube amount sensor, with tube amount displaying means, to detect and display the amount of winding tubes supported on the pegs along the storage lines. It also is important to display an alarm of preestablished minimum accumulation content reached, in order to prevent an emptying, or an idling of the whole equipment of dispensing of the collecting tubes to the individual winding stations.

Said sensors, of either mechanical, or optical, or electrical nature, or constituted by combinations of two or more of the above types, are presence sensors known in the art. They will enable, in the presence of the minimum accumulation level, a sound or light signal, either continuous or intermittent, to draw the attention of the operator attending the restoration of the winding tubes storage reserve.

The pegs on which the winding tubes are supported are positioned frontally and protruding in a position perpendicular, or substantially perpendicular, to the plane containing the development of the trajectory of movement of the traction element. In a particular form of practical embodiment of the accumulation, it is advantageous to place the winding tube-holder peg in a position not perpendicular to the traction line, and orient it obliquely upwards. An accidental slipping, due to an impact or to vibrations, of the winding tube, off from the winding tube-holder peg is practically unlikely, if the peg is slightly sloping upwards.

Advantageously, according to a further structural characteristic, the winding tube-holder peg is provided, at its free end, or in correspondence of its free end, with an enlarged portion, or its is provided with a cap analogous to a nail head, or similar shapes, which cause the winding tube to place itself in an upwards sloping position.

The frontal position, and the substantial perpendicularity between the plane on which the continuous traction element runs, and the protruding winding tube-holder elements, or pegs, allow the whole storage unit to be considerably simplified from the structural viewpoint, to act as the reserve accumulation for a large amount of tightly packed winding tubes.

The simplification in structure derives from the invariability of the position of the plane on which the traction element runs, and of the position of the winding tube slipped on its holder peg during the whole step of movement between the tube feed area, and the point of withdrawal of the individual winding tubes. The invariability in winding tube position secures the stability of positioning and of union between the winding tube and its holding peg in any areas of passage towards the withdrawal point, no guides or containment surfaces being therefore necessary to the purpose of preventing the individual winding tubes from sliding off from their protruding support elements. Furthermore, the filling area can extend to the whole storage front which is, with the type of positioning as herein proposed, freely accessible for the machine attending operator, or for a whatever automatic loading unit enslaved to the accumulation, or prearranged within the scope of the factory automation service. The hand insertion is therefore, ergonomically useful for the full accumulation front.

The withdrawal action, performed by means of the withdrawal device, does not in any way interfere with manual or automatic filling carried out during the time of replenishment, so that between the operative steps of withdrawal and filling there are no electromechanical and electronic logics of consent or inhibition.

The traction element is constituted by a conveyor chain to whose links the winding tube-supporting pegs or protruding elements are suitably fastened. The latter have a slim shape, to allow winding tubes having different inner diameters to be suitably slipped on them. The diameter, the shape and the dimensions of said winding tubes are standardized on the basis of the thread and of the different thread batches being processed, as well as on the basis of the type of subsequent process the thread undergoes.

Said chain, as the traction element of the whole accumulation, in order to achieve a tight and compact accumulation of a considerable amount of winding tubes under conditions of limited room, has the form of a set of coming and going lengths following each other, with parallel lengths obtained by means of return sprocket wheels, at least one of which is controlled by drive means.

All the above makes it possible to provide a so large number of reserve winding tubes, as to allow the winding stations to be automatically fed over many hours, or many working days, with no need to carry out any accumulation restoration steps.

The traction element can be constituted by a cable, or by a flat or toothed belt, equipped with winding tube-supporting pegs, with a closed-loop development achieved by means of return roller, at least one of which is controlled by drive means.

As the withdrawal actuator device, an intermittent dispenser lever is provided, which, by being driven to rotate between two angular positions, in coordinated cooperation with the indexing of the traction element, makes it possible for the pusher element to slip the winding tube off from the winding tube supporting peg. As a result, the winding tube drops on a stationary chute, which is mounted in an inclined enough position, as it is necessary to secure the sliding by gravity of the said winding tube onto the belt transfer device.

Such pusher element has the shape of a blade, or of a fork, or has similar shapes, suitable for slipping the winding tube off from the winding tube supporting peg.

The chain traction element, together with the tube support pegs integral with it, is indexed by a motor means associated with one of the stepwise advancement mechanisms, known in the art; and the drive means, which makes the arm rotate during the withdrawal step, is simply constituted by a rotary-solenoid actuator, or, as an alternative, by a pneumatic actuator, or by similar drive means, also known in the art.

Both said drive means are located in the top portion of the accumulation unit.

The winding tube withdrawal mechanism and the chain traction element can hence advantageously share the same motor means constituting the drive means controlling the two above-said intermittent mechanisms, which operate in series. In fact the one, by revolving the arm, moves the pusher element suitable to slip the winding tube off from its supporting peg, and returns back to its initial position, leaving to the other mechanism the possibility of advancing by one step the traction chain, to prepare a new winding tube to be subsequently withdrawn.

The slipping off direction is perpendicular to the travelling direction of the conveyor belt. The winding tube, thereafter, slides and deviates to be given to the transfer device, which is positioned along the whole front of the collection stations. The bends of the chute are accomplished with bending radiuses which must secure the sliding down by gravity, without jumps, and without any jammings, of the winding tube having the maximum size as provided for use in association with the device according to the present invention.

As the transfer device to transfer the winding tubes to the collection stations, as endless belt conveyor is provided, which receives the individual winding tube at the outlet of the chute, and translates it in the axial direction, up to the release point, corresponding to he coning station in doffing step. More precisely, the axially running winding tube is intercepted, withdrawn from the conveyor belt, and transferred to the doffing unit in standstill position, or is directly inserted between the bobbin-holder arms of the winding station.

A purpose of the present invention is to provide a transferring device having a so limited frontal overall dimension, that it can be easily placed frontally to the whole operating front of the textile machine, without substantially hindering the accessibility to the winding positions.

An advantageous aspect of the form of practical embodiment deriving from the use of a thin belt is, in fact, the horizontal position in which the winding tubes are fed to the collection stations, situated above the height of the cones being formed. The thin belt can have a flat configuration, without the invention being limited to this particular configuration. It is also possible to use the invention when the belt is replaced, e.g., by a structure constituted by chains or cables, or translating elements like these.

The conveyor belt, by means of which the winding tubes are conveyed along the collection front, to be transferred, when necessary, to the winding stations, must only have a width slightly larger than the maximum diameter of the winding tube, which must be inserted in the operating stations. The diameter of the return roller and the diameter of the drive roller must be small, to keep low the height of the said belt conveyor device. Such values must however be compatible with the inflexion of the rollers, in as much as this inflexion must be absolutely prevented in order that the whole may properly operate.

According to an advantageous characteristic of the present invention, the winding tube running track along the machine front is not equipped with divider elements, or with lever switches or with mechanical interceptor means associated with motion sources prearranged for each individual collection station, or for groups of collection stations. As a consequence, as the winding tube feed device does not require any mechanisms to be connected with, or derived from, the collection stations, can be installed in front of the machine front, without alterations, or structural interventions of a certain extent.

One of the purposes of the present invention is therefore to only put in coordinated cooperation the winding tube supply conveyor belt with the mobile automatic doffing unit, which advantageously includes within itself the device for winding tube interception, clamping and insertion between the cone holder arms of the winding station.

As the mechanical interceptor device, an arm lever is provided, whose end, having a blade shape, a shutter shape, or an equivalent shape, is prearranged, during the withdrawal step, in a position substantially perpendicular to the axial running direction of the winding tube.

The passage interception, thanks to the frontal hindrance constituted by the blade, prearranges the winding tube to be translated to leave the track of longitudinal movement of the conveyor belt.

The arm, which acts as the control stem of an electrical or pneumatical actuator, translates the winding tube to a precise reference position for the subsequent clamping and handling.

As the gripping device, an arm lever is provided, whose end is equipped with crossing and hinged levers forming a tongs assembly, which perform the function of gripping, clamping and conveying the winding tube in correspondence with the winding axis, to undergo the operation of clamping between the arms of the cone holder frame.

To the accumulation of ordered reserve storage winding tubes, positioned externally to the winding operating front, other similar accumulations can be placed side-by-side, with a simple composition, in order to have available a larger storage capacity, or to be able to operate with a plurality of thread collection batches simultaneously processed on the individual machine. The endless belt conveyor system can be given any desired length, in as much as the same belt is a moving driven element, and not a drive element. Said belt extends axially from the first accumulation to the last winding station.

A further purpose of the present invention is that the many winding units, constituting the automatic coner machine, can be advantageously subdivided into collection sectors, each composed by any desired number of units, since no mechanical or electromechanical operating elements is required for each individual workstation, or group of workstations. As a consequence, the number of winding units per working sector can be easily corrected by modifying the positions of the mechanical, optical or electromagnetic stops, which, in coordination with sensors, or other equivalent means, associated with the automatic doffing unit, are capable of detecting the position of said unit, and sending a signal, by means of which the device is set into operation to perform the winding tube withdrawal from the winding sector to which collection station the doffing step belongs.

A further purpose of the present invention is that the discharging of the already formed cones is advantageously carried out by means of one single axial conveyor means constituted by a conveyor belt, or the like. The difference in the cones, for the several wound thread batches, is evidenced by the unequal winding tube type, easily visible, or identifiable by color, or shape, or dimension.

The filled cones, different by thread type, are then transferred onto the conveyor belt which is provided on the rear side of the units, and are sent to the outlet into a container wherein the various cones are blended.

As a consequence, the following work of classification, carried out manually or by automatic means, become extremely easy, also in the presence of threads visually analogous to each other, thanks to the hereinabove mentioned differences in the winding tubes.

Differently, in the presence of identical winding tubes, associated with analogous thread batches, at the outlet from the conveyor belt, or in the collection container, cones would result, whose classification would becomes extremely difficult, with possible subdivision errors.

Errors of separation which affect the end product render it a processing waste, or, at least, have an influence on its quality level.

One of the valuable characteristics of the equipment according to the present invention consists in its suitability to be fitting both to the preexisting machine fronts, and to the fronts of the machines under preparation. Furthermore, operating devices enslaved to the equipment of the invention are not necessary, since said equipment operates in a completely automatic way. The equipment of the invention furthermore is composed of devices which are easily assemblable with each other. This characteristic makes is possible to propose advantageous variants to automate a machine front, or a plurality of machine fronts, with one or more accumulation units, provided side by side to each other, to make it possible to simultaneously wind a plurality of batches of different threads.

It results furthermore possible to feed, from one single central magazine, formed by one or more accumulation units, a whole department of winding machines prearranged to collect one or more thread batches. From said central magazine, having suitable dimensions, one or more conveyor lines branch, which are able to feed the winding tube transfer tracks leading to the operating fronts of the individual winding machines.

These variants are particularly destined to be inserted within a general factory automation cycle, according to the most recent trends in the textile industry. Another advantageous characteristic of the device of the present invention consists in its prevailingly mechanical operation. Besides the winding tube conveyor belt drive means, the accumulation traction element drive means and the lever system to slip the winding tubes off from the storage peg, no electrical, electromechanical or electronic parts having a certain relevance and enslaved to the device exist.

The apparatus according to the present invention makes it possible to dispense and convey winding tubes to the individual collecting stations of a textile machine, characterized in that it comprises, in cooperation and coordination:

a device for the ordered accumulation of winding tubes lined-up to one another, in a position of not adherence to and not contact with one another;

a withdrawal actuator device, which performs the step of slipping of the winding tube off from the winding tube holder peg, by means of an intermittent dispenser device;

a belt or cable transfer device, which transfers, in the axial position, the individual winding tube to the winding station, on request by this latter, or on request by the automatic doffing unit;

a mechanical interceptor device, of shutter or blade type, which stops and positions the winding tube, in its suitable position to be subsequently handled;

a taking device, to perform the necessary transfer and insertion between the cone-holder arms of the winding station.

Hereunder, for exemplifying and non limitative purposes, a preferred form of practical embodiment of the present invention is disclosed with the aid of the hereto attached drawing Figures wherein.

Figure 1:
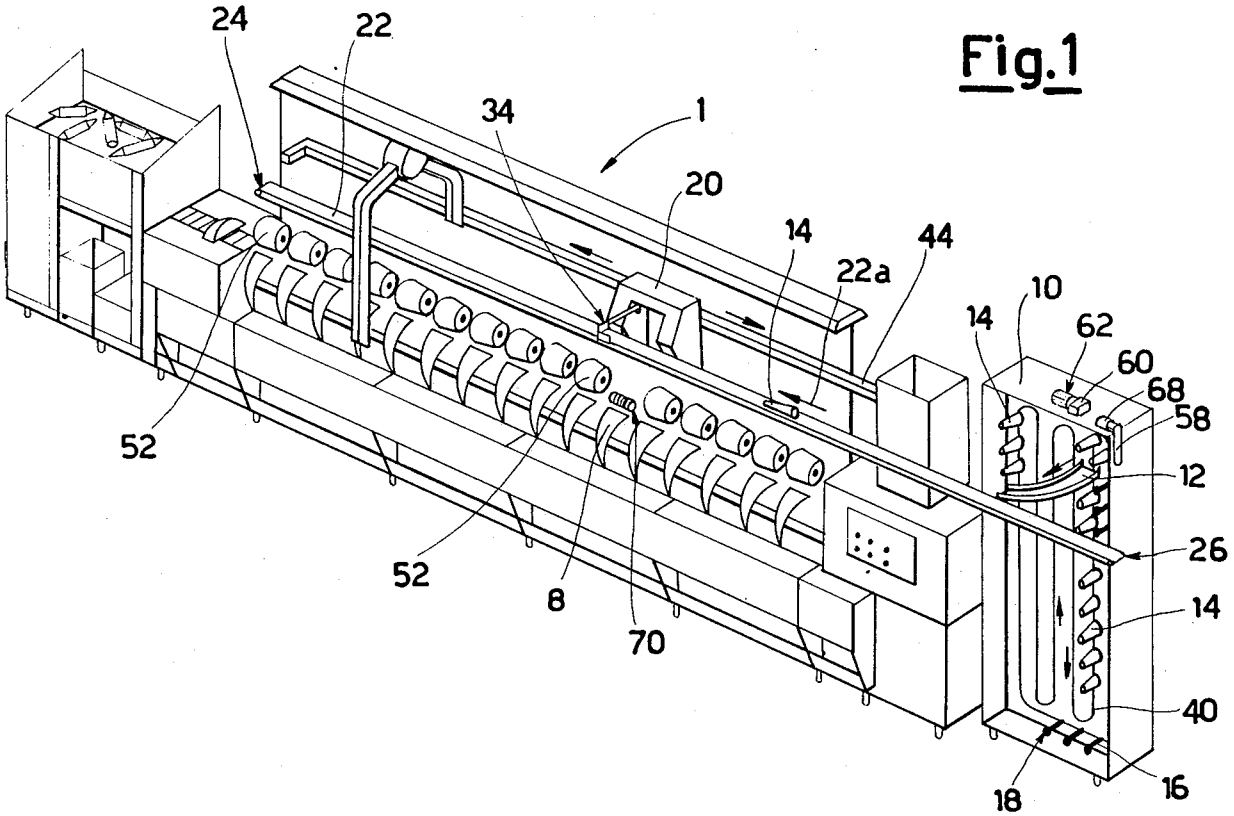
FIG. 1 is a diagrammatic view, in longitudinal perspective, of an automatic winding machine, with thread cross winding pattern, along which the equipment of the present invention, cooperating with the doffing unit, is assembled.

In the Figures, equal parts, or parts performing equal or equivalent functions are indicated by equal reference numerals.

In the Figures, we have that: 1 is a collection textile machine, producing cross-winding cones; 52 is the conical-shape cone; 8 is one of the winding stations, which, closely positioned side-by-side to each other, form the whole collection machine front; 10 is the unit for the ordered accumulation of winding tubes waiting for being individually sent to the winding stations; 16 is the protruding-peg element, onto which the winding tube 14, frontally positioned in reserve position, is slipped for support. The peg element 16 can be replaced by a frusto-conical, or cylindrical, stud, or by a support hollow, or by a housing trough, or by similar elements, capable of stably housing the winding tube relatively to its intermittent handling; 18 is an enlarged portion, provided at the end, or in the nearby of the end of the peg 16 supporting the winding tube 14.

Said enlarged portion 18 has the shape of a spherical cap, or has a nail-head shape, or has similar shapes, and its presence is such to make the winding tube 14 to assume an upwards oblique position, for the purpose of preventing it from getting slipped off from its supporting peg 16 in the presence of shocks and vibrations; 14 is the winding tube on which the thread is collected on the collection stations 8, forming the cone 52 of such dimensions, as established according to the production process. The winding tube 14 is given frustoconical shapes, or a substantially cylindrical shape; 40 is a traction element, to whose links the winding tube-holder pegs 16 are fastened.

The traction element 40 can be constituted by a cable, or by a tape, or by a flat or toothed belt, or by similar elements equipped with slipping-on pegs 16, to which a closed-loop configuration is given by means of return rollers, at least one of which is motor-controlled. A chain, as the element traction 40 of the whole accumulator 10, which too is given a goings-and-comings configuration, is in the form of a practical preferred embodiment. Drive means 62 controls the intermittent indexing of the traction chain 40. Mechanism 60, known in the art, makes it possible to intermittently index the traction chain element 40. Control drive means 68, drives the intermittent dispensing lever, which performs the slipping off of the winding tube 14 from its support peg 16. The control drive means 68 is practically constituted by a drive means consisting of a rotary-solenoid actuator, or constituted by magnetoelectrical, hydraulic, pneumatic means, or by a combination of two or more of such types. Arm lever 58 is driven to revolve between two angular positions by the control drive means 68 during the step of withdrawal of the winding tube 14 from the accumulator 10. Pusher element 48, makes it possible to perform the action of slipping of the winding tube 14 off from its support peg 16. Pusher element 48 has a blade shape, a fork shape or is given a shape, suitable to perform the slipping off of the winding tube 14. Fixed chute 12 receives the tube 14, slipped off from the support peg 16, and conveys it, releasing it, to the machine-front transfer device. The upper stretch 22 of an endless belt performs the function of a track along which the winding tubes run, as they are transferred, in their axial direction, along the collection station. The lower stretch is the return stretch of the endless belt. The case 28 longitudinally surrounds the endless conveyor belt. The side walls of the case 28 are defined by 25, suitably shaped and dimensioned to axially guide the winding tubes 14 to be released at the winding positions 8 and preventing them from going off the running track 22. Roller 26 has a small diameter and guides and drives the endless conveyor belt. Drive roller 24, driven by a driving means, not shown in the Figures, has a sufficiently small diameter, which guides and drives the endless conveyor belt. Automatic doffing unit 20, mounted on a saddle running, e.g., along rails, which can travel along the whole machine front in front of the winding stations 8.

On many automatic winding machines 1, many bobbin change devices 20 have been proposed and practically embodied, wherein cones completely wound with cross-wound thread are withdrawn from the collection stations, and replaced by the winding tubes 14. According to the hereto attached diagrams, the doffing device 20 is constrained, by means of wheels 45, to the guide rails 44 positioned above and along the winding stations 8. This doffing device runs along the collection positions 8, prearranged on line, each time stopping in correspondence to that station wherein the cone has reached a predetermined diameter, or a predetermined amount of wound thread.

The full cone gets disengaged from the arms 72 by means of a discharge mechanism, not shown in the Figures, provided on the automatic doffing device 20, and is replaced by the empty tube 14 to carry out a new rewinding. Conveyor belt 54 is provided along the rear side of the collection stations 8, which receives the full cones 52, to automatically convey them out of the automatic coner machine 1 into a receiving container 50, whose position may require further transfer belts 56. Arm 34 of doffing device 20 intercepts and transfers the winding tube out of the tube running track 22. Arm 34 performs the function of a control stem for an electrical or pneumatic actuator 36 fastened, and hinged, through the pin 37, onto the running automatic doffing device 20. Interceptor blade 32 intercepts the winding tube 14 while the tube is running along the transfer belt. Arm lever 38, holding, at its end, tube-clamping elements, indicated by the reference numeral 42, are provided as pairs, capable of clamping, due to their tongs-shape, the tube 14 to convey it, by rotation around the pin 39, in correspondence with the winding axis, to replace the expelled cone 52 between the collection arms 72. Spindle 71 is a pivot around which the collecting tube clamping arms 72 rotate, wherein the collecting tubes 14 are driven to revolve, under dragging and friction action, by the winding roller 70, equipped with grooves to guide the thread, during its deposition. Sloping plane 29, made from metal sheet, has its position fixed and supports the winding tube 14 while it is being translated, by means of the arm 34, from the track 22 it was travelling along, to a precise stop position determined by a movable plane 30, whose end has a tray shape. Inside the tray 30 the tube 14 is housed, the tube 14 assuming a precise position, which enables the clamping by the tongs 42. The mobile plane 30, by rotating around the pivot 31, enables the arm 38 to revolve, without any interference, around the hinge pin 39 and, consequently, making it possible to insert the tube 14 between the arms of the cone-holder frame 72. Slightly sloping plane 46 made from metal sheet, supports and conveys, by gravity, the full cone 52 onto the conveyor belt 54, provided on the rear side of the collection stations 8. The full cone 52 is expelled from the arms 72 by means of a discharge mechanism provided on the automatic doffing device 20. Mechanical switches 80, of blade type, or the like, acting on the cone-travel tracks, make the cones or the winding tubes reach predetermined handling areas. Mechanical switches 80 can be fixed, or movable, by imposing precise angular movements to them. Reference numeral 75 shows the facilitated route, along which the operator charged with restoring the accumulator reserve on the various magazines of the individual collection machines 1, 2, 3, 4 walks. Reference numeral 74 shows, a facilitated route, along which the staff charged with the supervision of a winding bay - which, in the Example shown, is schematically formed by four winding machines 1, 2, 3 and 4 - walks.

The operation of the equipment according to the present invention is set forth hereinafter.

The automatic coner machine 1, having a large number of working positions, closely positioned in a side-by-side relationship to each other, is associated, in coordinated cooperation, with a doffing device 20. The doffing device is rendered movable along the whole winding front by means of travel ways, comprising one or more rails 44, having any desired shape, cooperating with suitable rolling means 45 such as wheels, or rollers, or other equivalent means.

During the operation of the collection machine 1, the doffing device 20 is reciprocated in a continuous fashion in correspondence with the reeling points, carrying out a pendular patrolling. The mobile device can be moved along the collection points by means, e.g., of an electrical motor (not shown) installed on it, and associated with a whatever actuation system to actuate friction drive wheels, provided with at least one drive wheel, and with electrical energy being supplied by means of power supply lines, known in the art.

With regard to the device 20 for the automatic cone doffing, in the present invention a device known from the prior art is used, and therefore the description of its lever systems and of its structure is omitted.

When a cone 52, supported, during the collection process, by the arms 72 and driven to rotate by the grooved roller 70 on which the thread runs, reciprocatingly, reaches a preestablished amount or length of collected thread, the reeling is discontinued, in a way per se known.

An electrical, or optical, or electromechanical signal indicating the reeling completion is immediately initiated according to the known art by a signal means 81. The self-driving device 20, moving during its patrolling function, detects such signal and stops, frontally centering itself, in correspondence to the winding station waiting for the doffing. The operation starts the expulsion of a full cone 52, which is disengaged from the clamping arms 72, and is sent onto a conveyor belt 54, to be transferred and stored outside the automatic coner machine 1. The conveyor belt 54 is provided on the rear the of said winding station, i.e. on the rear side thereof, assuming that the side of thread motion is the front side. The chute 46, made from metal sheet, is slightly sloping towards the conveyor belt 54 and has an inclination angle large enough to enable the full cone 52, disengaged from the arms 72, to roll due to its own weight. Simultaneously, at the beginning of the cone 52 expulsion operation, a signal is transmitted to the drive means 68 which drives the withdrawal device to withdraw the individual winding tube 14 from the accumulation 10.

More precisely, the control drive means 68, energized by the said signal, starts rotating, according to the arrow 59, the arm lever 58, which, in its operative action, assumes the position shown by the dotted lines in 58a.

The arm lever 58 is integral with the pusher element 48. The two elements are in a position substantially perpendicular to each other.

The angle of rotation of the arm lever 58 shifts, along a practically rectinilear route, the pusher element 48, which causes the winding tube 14 to be slipped off from its support peg 16. The angle of rotation of the arm lever 58 must assume a large enough value to secure a long enough shift of the pusher element 48, which completely slips the tube 14 off from the support constituted by the peg 16. The control drive means 68 supplies the dispensing lever assembly 58 and 48 with a fast enough dispensing motion, to submit the tube to an high enough impulsive slipping-off thrust.

Figure 3:
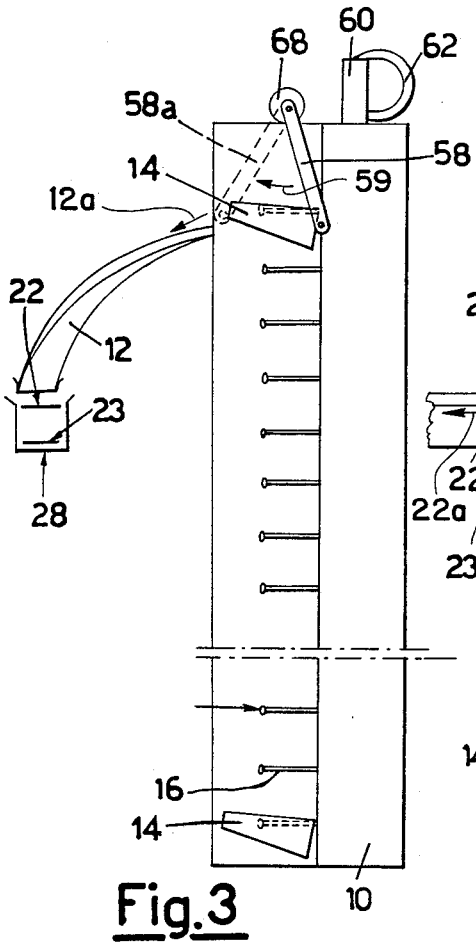
FIG. 3 shows a side view of the accumulation of FIG. 2, wherein the operation is schematically shown of the pusher element, which performs the slipping of the winding tube off from its holder peg.
Figure 4:
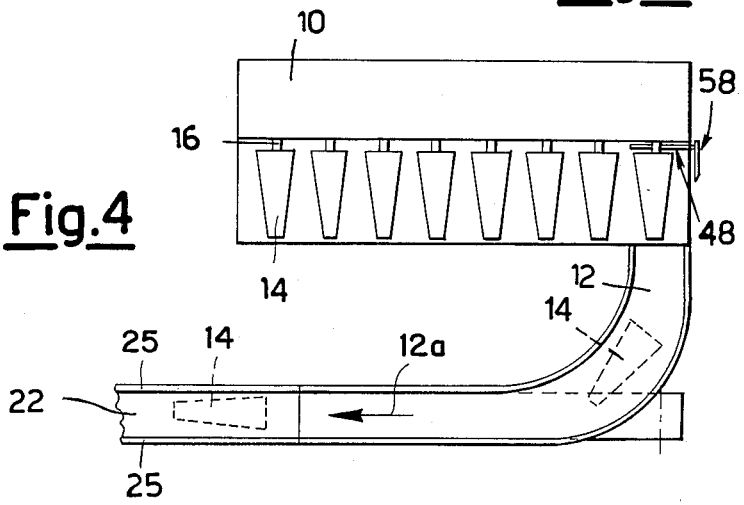
FIG. 4 shows a plan view of the accumulation of FIG. 2, wherein the winding tube running track from the chute and its confluence, for winding tube consignment, with the transfer belt, are schematically shown.

As a result, the winding tube 14 is delivered to the stationary sloping chute 12 with a rather large momentum. This momentum, jointly with the force of gravity arising from the sloping arrangement of the chute 12, enables the winding tube 14 to quickly slide onto the conveyor belt means 22, as indicated by means of the arrow 12a visible in FIG. 3 and in FIG. 4.

The dispensing lever assembly 58 and 48, still due to the action performed by the control drive means 68, or due to a simple elastic action, returns to its standstill position. More precisely, the arm lever 58, after assuming the position 58a, reverses with continuity, without any waiting times, the angular rotation in counterclockwise direction, to return back to its starting point.

The restoration of this latter position originates istantaneously in cascade an electrical, or electronic signal, which activates the drive means 62. This latter advances by one step the chain traction element 40, through the mechanism 60, endowed with the characteristic of intermittence, and either directly or indirectly integral, by means of gear wheels or levers, with the sprocket wheel which drives the whole meandershaped length of the accumulator, provided with the frontal protruding pegs 16.

Figure 2:
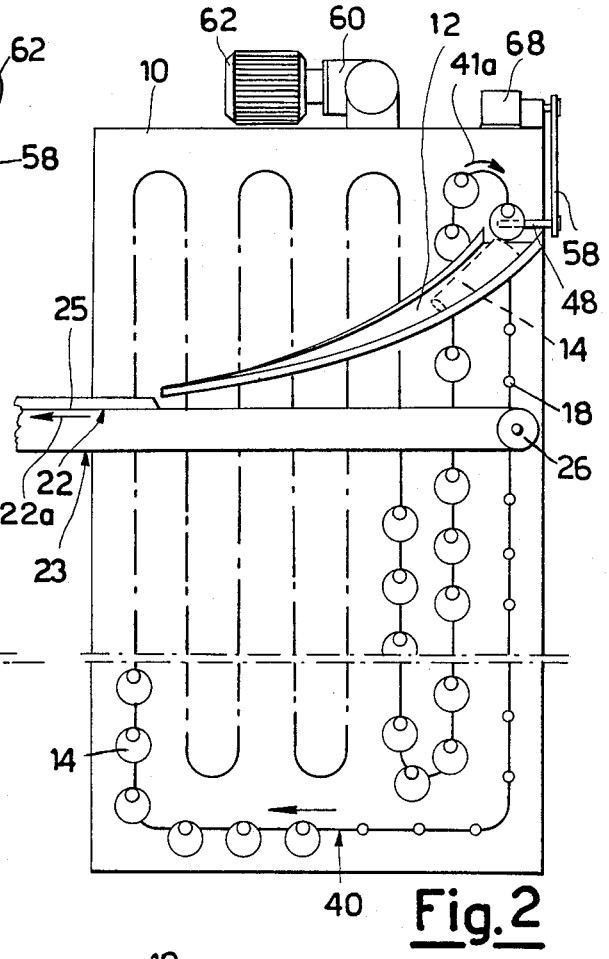
FIG. 2 shows a front view of the accumulation, which schematically shows the bent development of the traction element provided with support pegs, together with the withdrawal lever system cooperating with the inclined-plane chute which leads the winding tube towards the conveyor belt.

The value of the step indexing, which takes place, e.g., clockwise, as shown by the arrow 41a visible in FIG. 2, exactly coincides with the pitch between two consecutive pegs.

After such operations, during which the whole accumulation is moved by one step, a new winding tube 14 is positioned in front of pusher element 48, and waits for the subsequent signal as above-said, which activates the control drive means 68. The winding tube 14, slipped off from its support peg 16, sliding and turning comes to the outlet of the stationary sloping chute 12, with a speed suitable for it to be fed to, and collected, without any bounces, by the flat conveyor belt 22, which conveys it rapidly, always keeping it in its axial position, towards the winding position for which it was dispensed, on request by the automatic doffing device 20.

The flat belt 22 results, advantageously, to be provided with a continuous motion, and is hence devoid of electrical or electronic systems to enslave its motion to the sequences of the operative cycles of the upstream withdrawal systems and of the downstream interception systems.

The winding tubes 14, required to feed the winding positions, are translated according to their axial direction on said conveyor belt 22 in the direction as indicated by the arrow 22*a*, visible in FIG. 1, 2, 7 and 8.

The shaped side wall 28 and the upper stretch of the endless conveyor belt 22 drive the winding tube 14 to come to interfere with the blade 32 of the interceptor device. The impact, which derives from the interference, can generate a rebound of the tube 14. The magnitude of said rebound should not be such as to create the danger that the same tube may come off from its housing. This latter is formed by the tube running track 22 and by the side walls 25 of the case 28, which are given such suitable shapes and dimensions, as to keep the tube in a axial drive position, and to position it in its suitable position for the subsequent handling.

The arm 34, of the intercerceptor device, is actuated prior to, or simultaneously with the beginning of the operation for the expulsion of a full cone 52, or the putting into action of the drive means 68, which activates the dispenser lever assembly which performs the slipping off of the cone 14 from its storage peg 16. The actuator 36, fastened and hinged, through the pin 37, to the automatic doffing device 20, actuates, outwards, the stem 34, in order to prearrange its free end in a position to intercept the winding tube 14, axially moving along the collection front.

The free end is given a reverse-channel shape, inside which the tube 14 axially enters and comes to a stop against the blade 32. Said blade 32 is fastened at its rear end to close the axial transit passage through the vault-shape channel.

The blade 32, acting as a frontal hindrance, assumes a position substantially perpendicular to the axial movement of the winding tube on endless belt 22.

The end of stem 34, which has a vault-shape configuration on the sides and top and a frontal blade shape, stops the running tube 14, and positions it stably after rapidly containing and damping the rebounds which are generated because of the impact.

More precisely, the tube 14 is pushed, with a slight constant force, against the inner surface of the blade 32 due to the effect of the sliding friction, which is present due to contact between the winding tube 14 and the upper, flat surface of the running belt 22 on which said tube is supported. The presence of tube 14, which applies a slight axial pressure to the blade 32, being ascertained, the actuator 36 is activated, and by its drive action retract the stem 34.

The ascertainment of the presence of the winding tube 14 inside the end of the stem 34 is performed, e.g., by a contact sensor associated with the blade 32, or by optical, or electrical sensors, or sensors of any other known types. Such sensors, in the presence of the tube 14, send a consent signal which activates the actuator 36.

Figure 5:
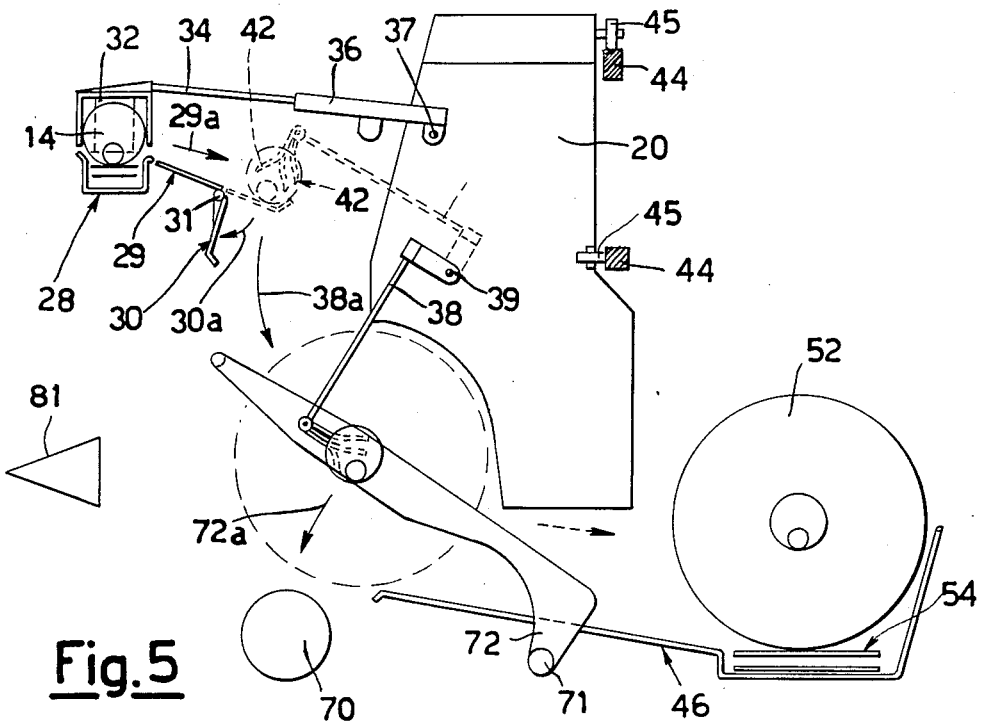
FIG. 5 shows a side view of the interceptor, taking and handling elements, wherein the steps of transfer movement of the winding tube from the conveyor belt to the winding axis is schematically shown.
Figure 6:
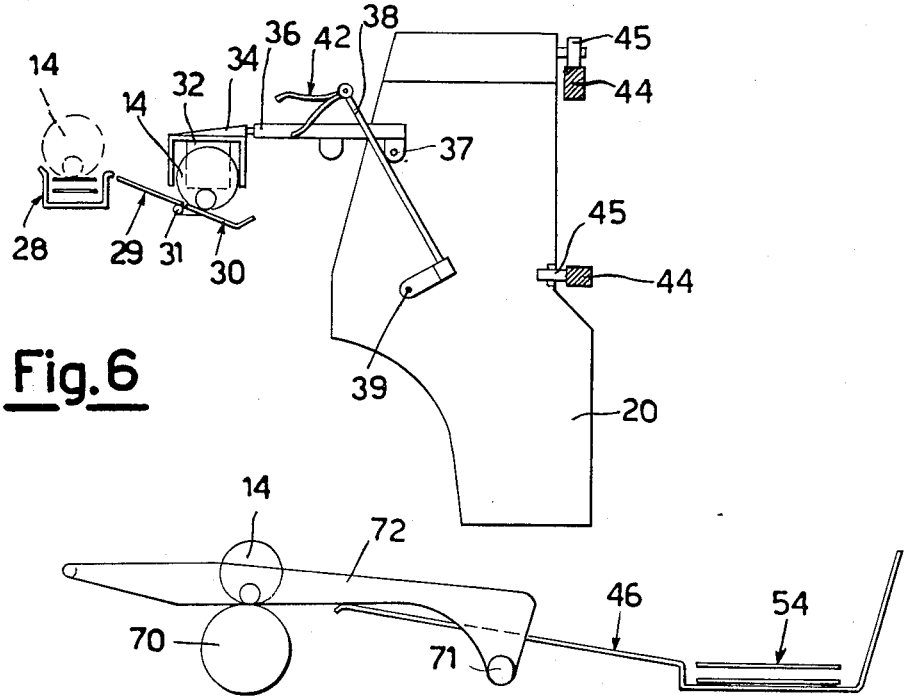
FIG. 6 illustrates a side view of the elements present in FIG. 5, wherein the operation is schematically shown of the interceptor arm, already shifted rearwards, to a position waiting for the winding tube. This rearward position being suitable for subsequent handling.

The stem 34 drags, by means of its end, the tube 14 out of the longitudinal running track of the conveyor belt 22, guides it on the stationary support plane 29, as indicated by the arrow 29*a*, visible in FIG. 5, and positions it on the movable plane 30, housing it on the tray-shaped end thereof. Inside such reference tray, the winding tube 14, in coordinated cooperation with the operative cycle of the actuator 36, is withdrawn by the arm lever 38, by means of the tongs elements 42. These latter surround, on opening command, or by elastic deformation, the outer surface of the winding tube 14, clamping and constraining it, in order to secure its transferral to the winding axis, by allowing the operation of clamping between the arms 72 of the cone holder frame. More precisely, after the end of the clamping step by the associated tongs 42, the movable plane 30 rotates around the pivot 31, simultaneously to, or very shortly after, the beginning of the rotation of the arm 38 around the hinge pin 39.

The two rotary movements are indicated by the arrows 30*a* and 38*a*, visible in FIG. 5.

The movable plane 30 can rotate due to the direct action of a pneumatic actuator, or of other similar actuators, known from the prior art, or it can rotate by the action of the contact pressure applied by the tube 14, driven in interference movement by the arm lever 38.

In this latter case, the movable plane 30 is elastically yielding. The arm lever 38, continuing its substantial revolution around the hinge pin 39, brings the tube 14 in correspondence with the winding axis, replacing the expelled cone 52 between the collection arms 72 on which the related centering seats are provided. Between said centering seats, the tube 14 is clamped in a per se known way. The clamping tongs 42 open and disengage from the tube 14 to release tube 14. The arms, the levers and the elements associated with them return to their initial positions, with translations and rotations taking place in sequences reverse to the disclosed ones. Simultaneously, the revolution drive of the arms 72 is enabled, and the arms 72 sink together with the winding tube 14 along a circular route, as indicated by the arrow 72*a*, visible in FIG. 5. After achieving the contact between the tube 14 and the winding roller 70, the thread collection process begins once again.

After the end of the operative cycle of expulsion of the full cone 52, and the insertion of a new winding tube 14, according to the above disclosed procedure, the doffing device 20 starts moving along the coner machine 1, reciprocating rightwards and leftwards looking for a collection station 8 exposing a subsequent doffing request.

Each collection station 8 corresponds to a working position of the device 20. The drive means, the mechanisms and the elements entrusted with carrying out the various operating steps of the cycle of doffing, and of the cycle of insertion between the arms of the winding tube 14, are not shown, and therefore they are not described, in that they are not within the scope of the present invention.

Furthermore, the correct sequential order and the duration of the above-disclosed operating steps are determined and maintained by means of a motor-driven mechanical drive mechanism with cams, or of drive means of pneumatic nature, or of drive means of different nature, not furthermore represented, because they are known from the prior art.

The operative steps of full cone 52 expulsion, and the operative steps of new tube 14 handling and insertion between the collection arms 72 can be advantageously overlapped, to make very short times pass between a reeling end and the beginning of a new reeling step.

On super-long machine fronts and at the collection stations 8 farthest away from the accumulator 10, rather long times for tube 14 transfer from the support peg 16 to the interception by the blade 32 elapse.

Thus, waiting times of the doffing device are generated, due to the lack of the winding tube 14 being in its thrust position on the interceptor blade 32.

With the high production rate reached in the present automatic machines, even waiting times representing a small percentage of the total cone reeling time assume considerable importance due to the delays in the subsequent interventions of the doffing device at the stations which are waiting for the cone expulsion, which casually can be more then one. In each collection station, there is a difference in the time necessary to form a full cone, due to various reasons, such as the number of thread breakages, different knotting times, and the like. The winding time is completely casual at any winding speed. Full cones can occur simultaneously along the whole machine front. If the reeling begins at different times, the cone discharge can occur at the same time at a plurality of collection stations.

To obviate this drawback, the present invention provides the presence of a transit reserve storage inserted in or associated with the doffing device 20. At each withdrawal of the winding tube 14 from the transit storage, an electrical signal is generated, which enables the dispensing of a new tube 14 from the accumulator 10, and the transfer thereof along the tube running track 22. When the winding tube is intercepted and transferred by means of the arm 34, it is stored inside the transit storage. The mobile doffing device 20, during its patrolling run, stops before a winding station waiting for the full cone 52 expulsion, withdraws the winding tube 14 already available from the transit storage and transfers it, by means of the arms 72, between which the cone 52 disengaged in a very short time before, to be conveyed to the conveyor belt 54. The operating steps of tube 14 withdrawal and insertion between the arms 72, and the operating steps of disengament and expulsion of the full cone 52 are advantageously overlapping and simultaneous. All the above makes it possible to carry out the automatic doffing intervention within a very short time, which is constant for all the winding positions, along the whole collection front. The intervention time of the movable doffing device 20, allowed by the transit storage is in fact devoid of waiting times, and is only bound to the fastness of the actuations of the various lever assemblies enabled during such operating step.

Said time is constantly repeated, to an equal extent, on all the winding stations, independently from their distance from the accumulator 10 from which the winding tubes 14 are dispensed. The transit storage can be a reserve of a single tube 14, or it can be constituted by a reserve of two or more tubes, with the invention being not limited to this.

The invention can be used also when the transit storage consists of a reserve of two, or more, tubes, different in shape and/or color from each other, suitably positioned, according to their different nature, to feed machine sections prearreanged to wind different thread types.

Figure 7:
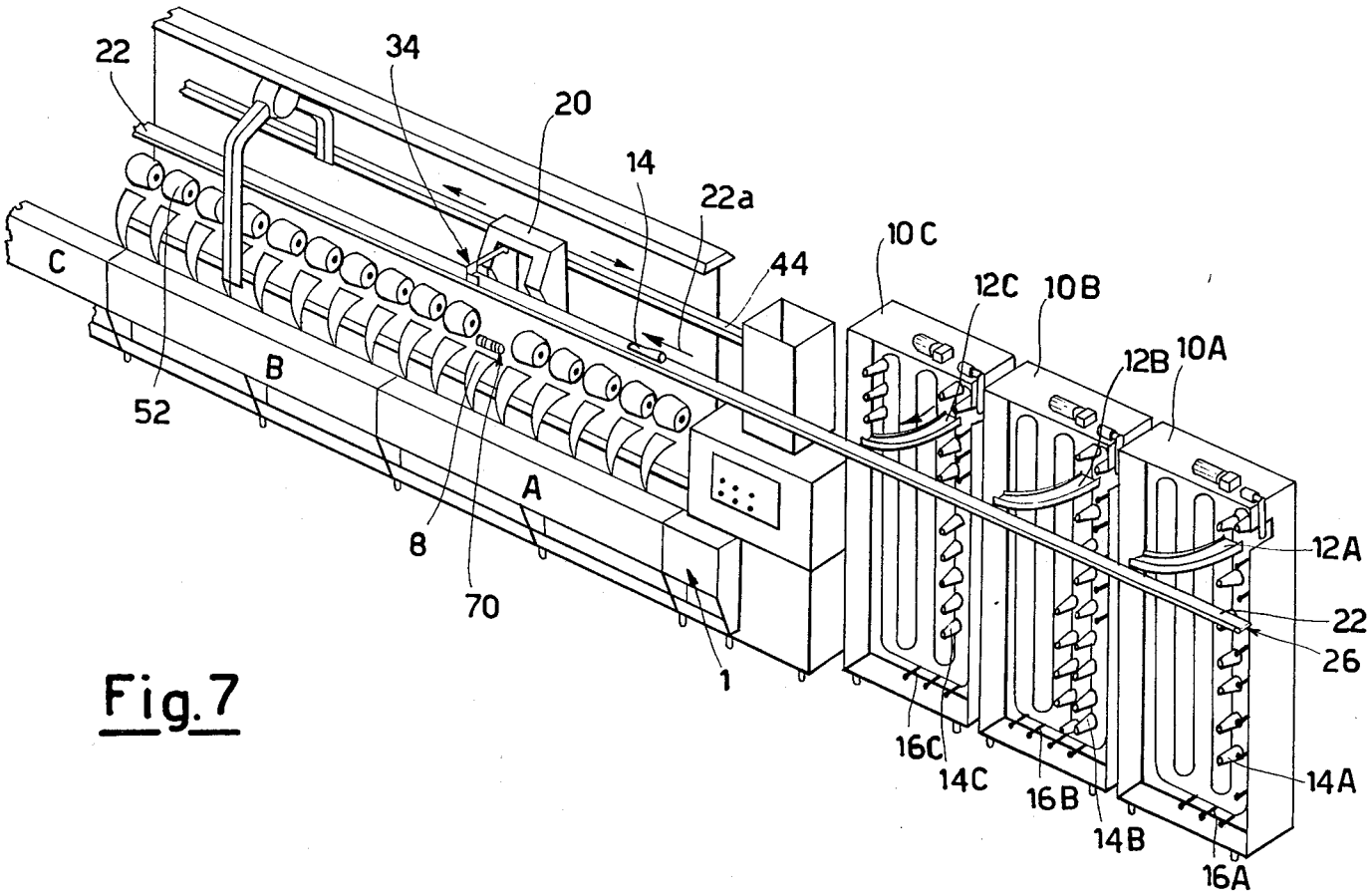
FIG. 7 is a diagrammatic view of a partial longitudinal perspective view of an automatic winding machine, which results equipped, externally to the operating front, with three side-by-side accumulations, from which different winding tubes leave, to feed different collection sectors.
Figure 9:
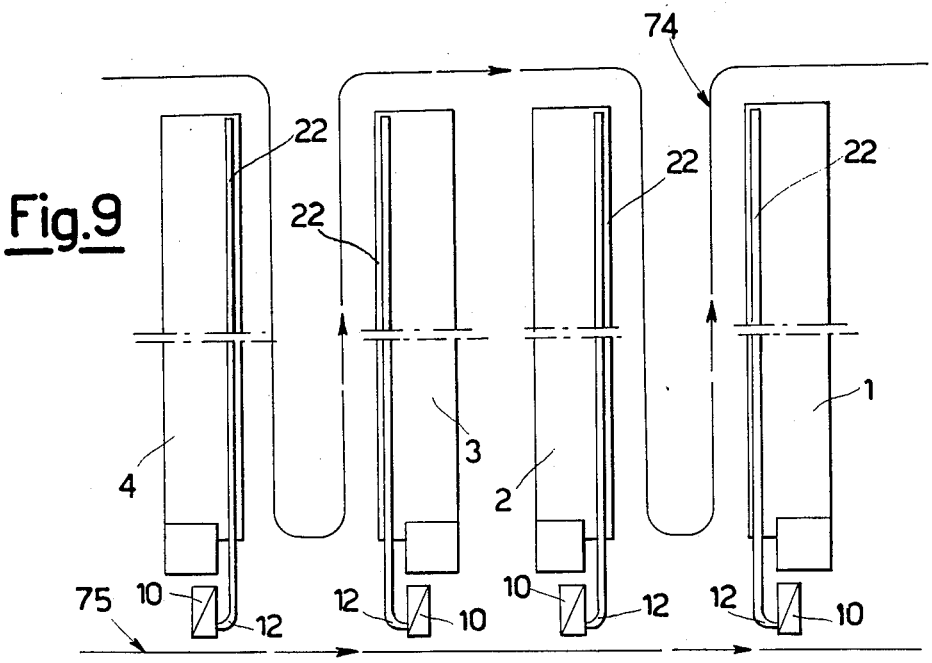
FIG. 9 is a plan view showing a facilitated route run along by the staff charged with the supervision of a winding bay, together with the straight route run along by the operator entrusted with the restoration of the reserve accumulation stored in the magazines of the individual collection machines.

FIG. 7 exemplifies the case in which the threads of three different batches are reeled by a single coner machine 1. More particularly, FIG. 7 is a general perspective view, aiming at explaining the method of automatic feeding to the automatic coner machine 1 of the winding tubes of different types, for shapes and/or colour.

The equipment to dispense and transfer to the individual collection stations, winding tubes of one type only, hereinabove disclosed, can be applied as such, without any substantial changes, to the dispensing and transfer of winding tubes of different types to the various collection sections of the single coner machine 1. The collection sections are pre-arranged to each collect a thread type.

Referring to FIG. 7, the present invention is furthermore explained on the basis of the request to feed the collection front with three different types of tubes to wind the threads belonging to three different batches A, B and C.

The textile machine 1 is equipped with a plurality of collection points 8 provided side-by-side to each other, some of which are pre-arranged to wind the thread of the batch A, some others of which are pre-arranged to wind the thread of the batch B, and further ones of which are pre-arranged to wind the thread to the batch C. The three types of winding tube 14A, 14B and 14C are stored in three accumulators 10A, 10B and 10C, simply placed side-by-side to each other. Each accumulator is equipped with the device to withdraw the tube from its support peg 16, and with the stationary shute 12, which transfers the winding tube 14 to the conveyor belt 22, the sole transfer means for the three accumulations 10A, 10B and 10C.

The transfer of a tube 14A, or 14B or 14C to a collection station 8, belonging to one, or to another reeling sector, as well as the actuation of the corresponding dispenser device to dispense the tube from the accumulator 10A, or 10B or 10C, is carried out by means of a logics, which makes it possible to recognize the position of the movable doffing device 20 in the sector A, or B or C, wherein its intervention was requested, and from which the signal leaves, to activate the drive means to slip the tube off from its support pin 16A, or 16B, or 16C. In order to detect the position of the movable doffing device 20, there can be provided, e.g., mechanical stop elements, or optical elements, or electromagnetic elements which, in coordination with sensor means, or other equivalent means, are able to detect, moment by moment, the position, along the machine front, of said movable device 20 during its patrolling run.

According to the arrangement shown in FIG. 7, the operative sequence takes place in the following order:

the self-driven device 20 stops before a winding station 8 which is waiting for doffing the full cone 52;

the winding sector A, or B, or C wherein the intervention of the movable doffing device 20 was requested, is detected;

the electrical signal, which activates the drive means of the lever assembly to withdraw one single winding tube 14A, or 14B or 14C from the corresponding accumulation 10A, or 10B, or 10C leaves;

the winding tube 14A, or 14B, or 14C is transferred, through the stationary sloping chute 12A, or 12B, or 12C, onto the tube running track 22, and said tube is intercepted by the arm 34, to be subsequently handled;

the electrical signal is generated, which activates the drive means to advance by one step the chain traction element of the accumulator formed by the support pins 16A, or 16B, or 16C, corresponding to the withdrawn winding tube 14A, or 14B, or 14C.

It should be observed that although the invention has been disclosed by referring to the form of practical embodiment wherein the automatic coner machine is subdivided into three winding sectors, the number of winding sectors can be increased to four, or more, by simply approaching the accumulator assemblies 10, one after the other, with substantially one accumulator assembly per each winding sector. This makes it possible to propose advantageous variants to automate one coner machine front, or a plurality of coner machine fronts, by means or one or more central accumulators, wherein the collection tubes are manually, or automatically, inserted, in such a large enough number as to cover many machine operating hours.

Figure 8:
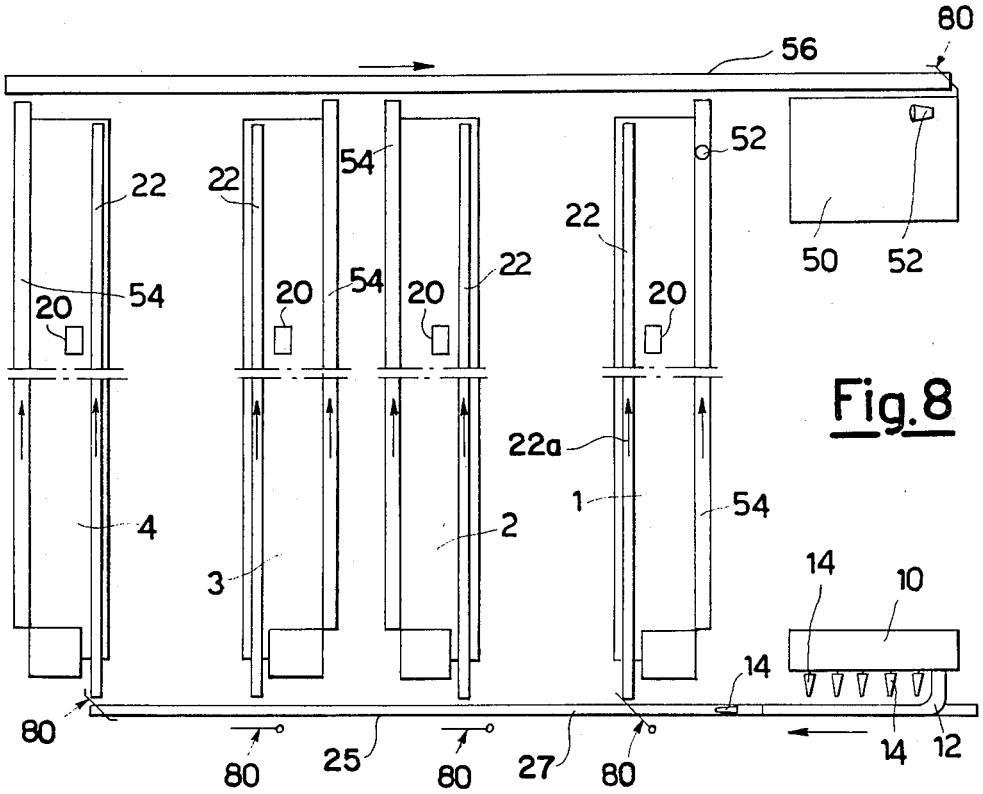
FIG. 8 is a plan view schematically showing an example of usage of the equipment according to the present invention inside a general factory automation system.

According to a further characteristic of the invention, as shown in FIG. 8, the accumulation device 10 can be pre-arranged to enslave the operating fronts of a plurality of machines, and for such purpose a plurality of transfer belt means 22, of the hereinabove disclosed type, or of any other types as desired, are provided. More precisely, a conveyor belt 27 is positioned frontally to the accumulator 10, onto which the winding tubes 14 are delivered by means of the sloping chute 12. The conveyor belt 27 is provided, in correspondence with each conveyor belt 22, feeding each individual machine front, with a mechanical switch of blade type 80, or the like, movable around a hinge pin to intercept and deviate the winding tube 14, making it arrive to the winding station which requested it. The doffing device 20, operating on the various machine fronts 1, 2, 3 and 4 generate, during their operating step of full cone doffing, electrical signals which activate the drive means of the switches 80, simultaneously activating the drive means of the dispenser device, dispensing the winding tube 14 by withdrawing it from the support peg 16.

The central accumulator 10, as shown in FIG. 8, is placed at an end of the front line of the heads of machines 1, 2, 3 and 4 group, in order to minimize, without any constructive changes, the routes of supply to the operating fronts; it has furthermore a meander-shaped arrangement of its traction element 40, to a certain extent, in order that a sufficiently large number of winding tubes can be stored, to prevent it from being rapidly emptied.

According to a variant, not illustrated, a plurality can be provided of central accumulators positioned next to each other, or placed in any convenient positions, to supply unequal winding tubes to the collection fronts prearranged to simultaneously carry out the reeling of different thread batches.

It is within the scope of the present invention to provide a placing of the central accumulators 10 in any advantageous positions different from that shown in FIG. 8, or from those proposed in the different forms of practical embodiments disclosed up to now.

These variants are particularly designed for insertion inside a general factory automation cycle, according to the most recent trends in present textile industry.

The conveyor belt transfer devices must be made compatible with the movement of other elements, such as travelling cleaning units, the thread joining car, and so forth.

Hereinabove, a preferred form of practical embodiment has been disclosed with its variants, but other solutions are however possible.

So, ratios and sizes of the operating lever assemblies can be varied. A transfer conveyor belt can be provided, which is activated to perform its function of tube running track at each withdrawal signal. Shapes and dimensions of the tube interception device and of the device to insert the tube between the cone holder arms can be varied. It is possible as well to provide a different drive system to slip the winding tube off from its support peg and for cooperating intermittent indexing of the traction element, so, e.g., in that cooperation, one single drive means can be used, instead of the two drive means 62 and 68. It is possible as well to couple or remove drive means in order to advantageously coordinate the whole set of the various operative steps, and so forth.

These and other variants are hence possible, without thereby leaving the scope of the present invention.

What is claimed is:

1. Apparatus to dispense and convey a single winding tube having an axis at a time to an individual winding station of a textile machine having a plurality of winding stations, comprising at least one movable means to accumulate winding tubes in a spaced, sequential single orientational relationship;

means to withdraw the winding tubes intermittently from the movable accumulation means in an axial direction;

transfer means to convey one winding tube in its withdrawn axial position from the movable accumulation means to a selected mechanical interceptor means;

a mechanical interceptor means to stop the winding tube on the transfer means and remove the winding tube form the transfer means; and, a winding tube handling means to position the removed tube from the transfer means at the winding station.

2. The apparatus according to claim 1, wherein the movable means to accumulate is a motor-driven endless chain from which said winding tubes hang.

3. The apparatus according to claim 2, wherein the endless chain has spaced pegs extending transversely therefrom and from which said winding tubes hang.

4. The apparatus according to claim 3, including a link to fasten each peg to the endless chain so that both move as an integral body.

5. The apparatus according to claim 3, wherein the pegs protrude in a position substantially perpendicular to the plane containing the development of the endless chain.

6. The apparatus according to claim 5, wherein the movable accumulation means faces and is accessible to an operator at all times.

7. The apparatus to claim 5, wherein each said peg has on its free end a ring-shaped enlarged portion to prearrange the winding tube in an upwards sloping position, to prevent the winding tubes from casually slipping off from its support peg.

8. The apparatus according to claim 7, wherein said intermittent withdrawal means includes a pivotal pusher element positioned to push an end of the winding tube to move the winding tube off of the free end of the peg.

9. The apparatus according to claim 8, wherein said intermittent withdrawal means includes a sloping chute positioned intermediate said pivotal pusher element and said means to convey the winding tube.

10. The apparatus according to claim 1, wherein said means to convey is a belt conveyor.

11. The apparatus according to claim 10, said belt conveyor is a flat thin belt.

12. The apparatus according to claim 1, wherein the mechanical interceptor means comprises a pneumatically controlled arm having an end to which is attached a reversechannel shaped body having an expanding blade at one end thereof.

13. The apparatus according to claim 12, wherein the winding tube handling means comprises a pivotal arm having at its free end a pair of spaced tongs to grab the winding tube for movement to a winding station.

14. The apparatus according to claim 1, including signal means to direct a winding tube to said interceptor means.

15. Automatic process to dispense and to supply winding tubes individually to individual winding stations of a plural station textile machine, comprising accumulating winding tubes in ordered spaced sequential single orientational positions on movable pegs;

pushing a winding tube individually from its support peg by means of an intermittent dispenser lever system onto a transfer means;

transferring the individual winding tube in axial position, to a predetermined interceptor location along the transfer means on request by said winding station;

intercepting said winding tube during transfer, removing said tube from said transfer means and positioning said tube at said winding station for immediate winding thereon.

* * * * *